United States Patent [19]

Yamada

[11] Patent Number: 4,903,031

[45] Date of Patent: Feb. 20, 1990

[54] SATELLITE RECEIVER

[75] Inventor: Tsuneo Yamada, Tokyo, Japan

[73] Assignee: Trio Kabushiki Kaisha, Tokyo, Japan

[21] Appl. No.: 110,537

[22] Filed: Oct. 20, 1987

Related U.S. Application Data

[63] Continuation of Ser. No. 841,617, Mar. 20, 1986, abandoned.

[30] Foreign Application Priority Data

Mar. 26, 1985 [JP] Japan ..... 60-59553
Mar. 26, 1985 [JP] Japan ..... 60-59554
Mar. 26, 1985 [JP] Japan ..... 60-42366[U]

[51] Int. Cl.[4] ..... H01Q 3/02

[52] U.S. Cl. ..... 342/359; 342/352; 342/356; 358/349; 455/26.1; 455/3

[58] Field of Search ..... 342/352, 355, 356, 359, 342/422; 343/703, 713, 766; 358/349, 86; 380/52; 455/26.1, 186, 3, 4

[56] References Cited

U.S. PATENT DOCUMENTS 4,232,396 11/1980 Grimes ..... 380/13
4,317,213 2/1982 DiLorenzo ..... 380/7
4,510,623 4/1985 Bonneau et al. ..... 455/26.1
4,599,647 7/1986 George et al. ..... 380/52 X
4,675,732 6/1987 Oleson ..... 358/349
4,685,131 8/1987 Horne ..... 358/86 X
4,718,107 1/1988 Hayes ..... 455/4
4,723,320 2/1988 Horton ..... 455/186
4,768,229 8/1988 Benjamin et al. ..... 358/349 X

OTHER PUBLICATIONS

"STV: Satellite Television Magazine", (1/85); Ad for Draco Aimer III.

The Houston Satellite Systems' "Tracker IV", Satellite TV/January, Staff Report.

*Primary Examiner*—Thomas H. Tarcza
*Assistant Examiner*—Bernarr Earl Gregory
*Attorney, Agent, or Firm*—Sixbey, Friedman, Leedom & Ferguson

[57] ABSTRACT

A satellite receiver which can selectively inhibit the reception of radio wave of the improper program. This receiver comprises: a receiver unit; a reproducer unit to reproduce the signal received by the receiver unit; a control unit including (a) a first memory to store the designated transponder number, (b) a second memory to store the transponder number which is parental locked, and (c) a generator to generate a parental lock signal when the memory contents of the first and second memories coincide; and means for disabling the signal from the designated transponder to be reproduced by the reproducer unit in response to the parental lock signal. With this receiver, the radio wave from the designated transponder cannot be received.

6 Claims, 4 Drawing Sheets

SATELLITE RECEIVER

This application is a continuation of Ser. No. 841,617, filed Mar. 20, 1986, now abandoned.

BACKGROUND OF THE INVENTION

1. Field of the Invention

The present invention relates to a satellite receiver to receive the radio wave from the satellite and, more particularly, to a satellite receiver which inhibits the reception of the program which should not be seen by children.

2. Related Background Art

The satellite receiver adapted to receive the radio wave from the satellite directs the parabola antenna toward designated one of several satellites placed in a geostationary orbit in the equatorial space and then receives the radio wave which is generated from the designated satellite by the parabola antenna. The received signal is transmitted through the feed horn to switch the horizontally polarized wave and vertically polarized wave to the low noise amplifier and amplified. The amplified output of the low noise amplifier is converted to the frequency of, e.g., 1 GHz by the block down converter and supplied to the receiver including an image receiver and received. On the other hand, the satellite is provided with the transponders of, for example, twenty-four channels at intervals of 40 MHz. The antenna controller receives the output from the receiver and supplies a drive output to the parabola antenna and rotates the parabola antenna in the directions of east and west in response to the output from the receiver, thereby directing the antenna toward the designated satellite. In this manner, the antenna controller can select the proper satellite.

However, all of the programs from the satellites are not always suitable for children to see. There are also some programs which, the parents consider, should not be seen by the children. There is the case where the parents want to prevent the radio waves of such programs from being received by the children. Such an inhibition of reception will be referred to as a lock or parental lock in this specification.

In the conventional satellite receiver, the receiver itself is locked. Therefore, when the receiver is locked, all of the functions of the receiver cannot be operated, so that there is a drawback such that no radio wave can be received.

SUMMARY OF THE INVENTION

The present invention is made in consideration of the above-mentioned point and it is an object of the invention to solve the foregoing drawback and provide a satellite receiver which can receive the radio waves other than the radio wave from the transponder which is inhibited due to the lock.

A satellite receiver according to the present invention is provided with transponder designating means for designating the number corresponding to a desired transponder and transponder selecting means for selecting the radio wave from the transponder and enabling this radio wave to be received.

The satellite receiver of the invention also has memory means for storing the number designated by the transponder designating means in response to an instruction of the lock. When the lock is instructed, the number designated by the transponder designating means is stored.

On the other hand, the satellite receiver further comprises: detecting means for comparing the memory content of the memory means with the number corresponding to the transponder selected by the transponder selecting means and thereby detecting the coincidence between them; and control means for substantially disabling the transponder selecting means to receive the selected radio wave while a coincidence detection output is being generated from the detecting means.

In the constitution according to the invention as mentioned above, when the lock is instructed, the number corresponding to the transponder designated by the transponder designating means is stored in the memory means.

In addition, the radio wave from the transponder selected by the transponder selecting means is selected and received, thereby allowing the radio wave from this transponder to be seen and listened. Simultaneously, the number corresponding to the transponder selected by the transponder selecting means is also supplied to the detecting means and compared with the memory content of the memory means. As the result of the comparison by the detecting means, when the number corresponding to the transponder selected by the transponder selecting means doesn't coincide with the memory content of the memory means, the detecting means generates no output. Therefore, the reception of the radio wave from the selected transponder will not be influenced. When the memory content of the memory means coincides with the selected transponder number, the detecting means generates an output. Thus, in response to an output of the control means, the reception of the radio wave from the transponder selected by the transponder selecting means is substantially disabled. Therefore, the radio wave from the designated transponder cannot be received.

DETAILED DESCRIPTION OF PREFERRED EMBODIMENT

Figure 1:
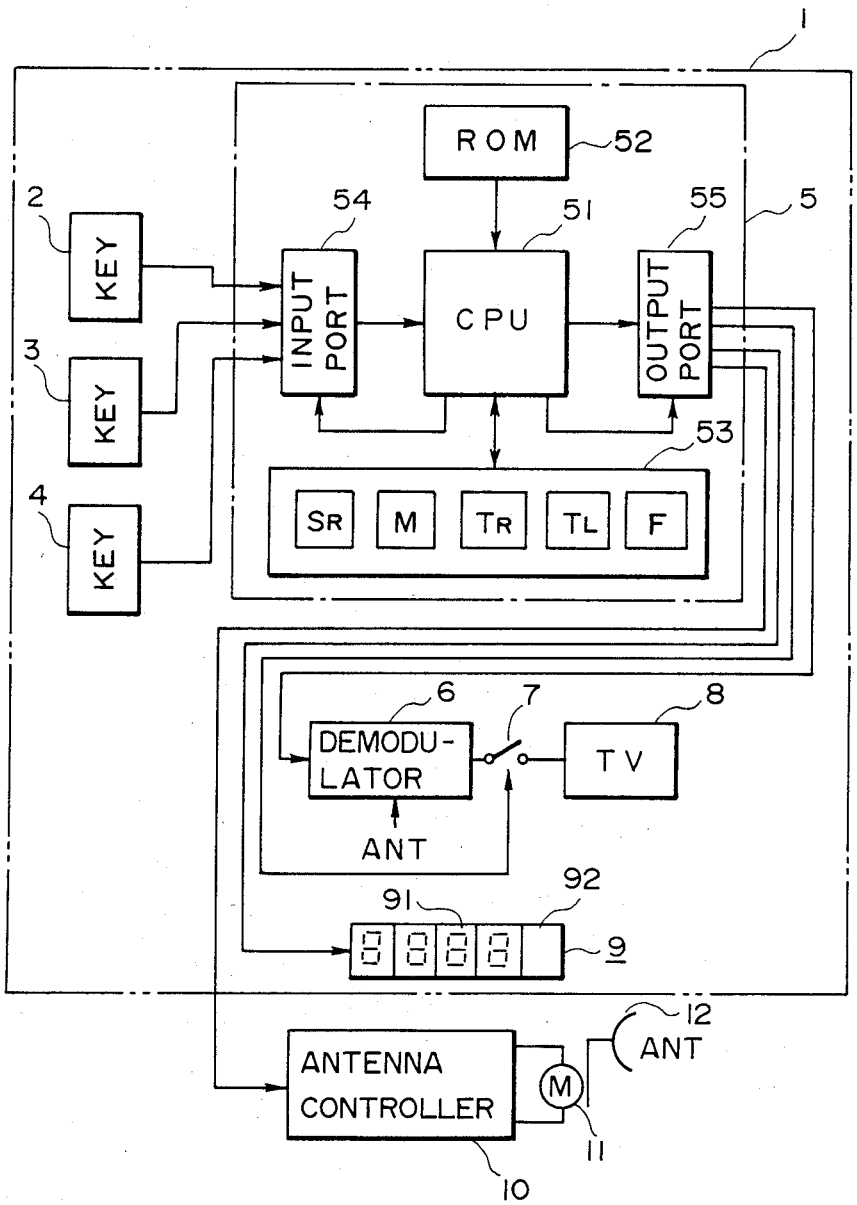
FIG. 1 is a diagram showing an arrangement of an embodiment of a receiver according to the present invention.
Figure 2A:
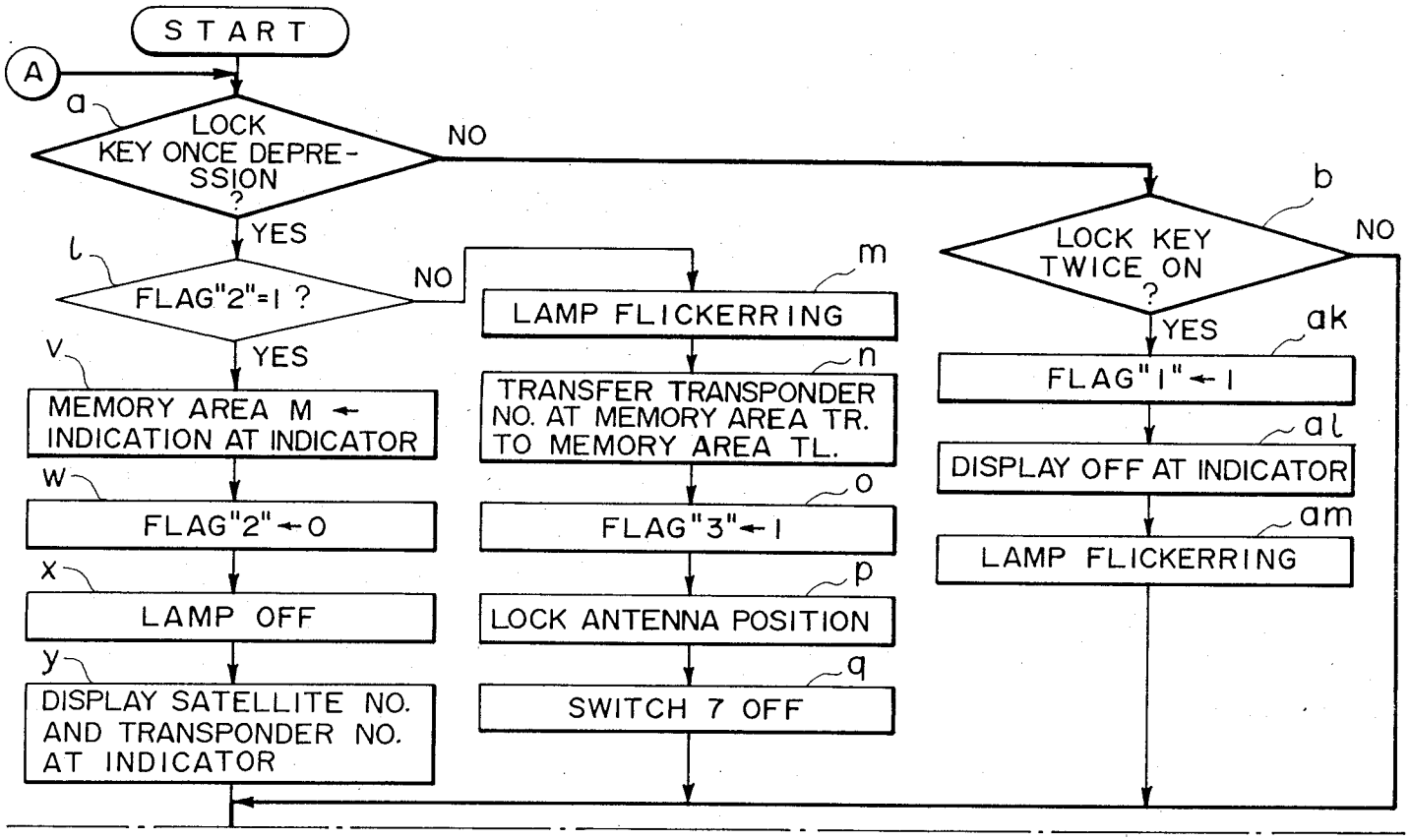
FIGS. 2A, 2B, and 2C are flowcharts showing the operation sequence of the receiver of FIG. 1.
Figure 2B:
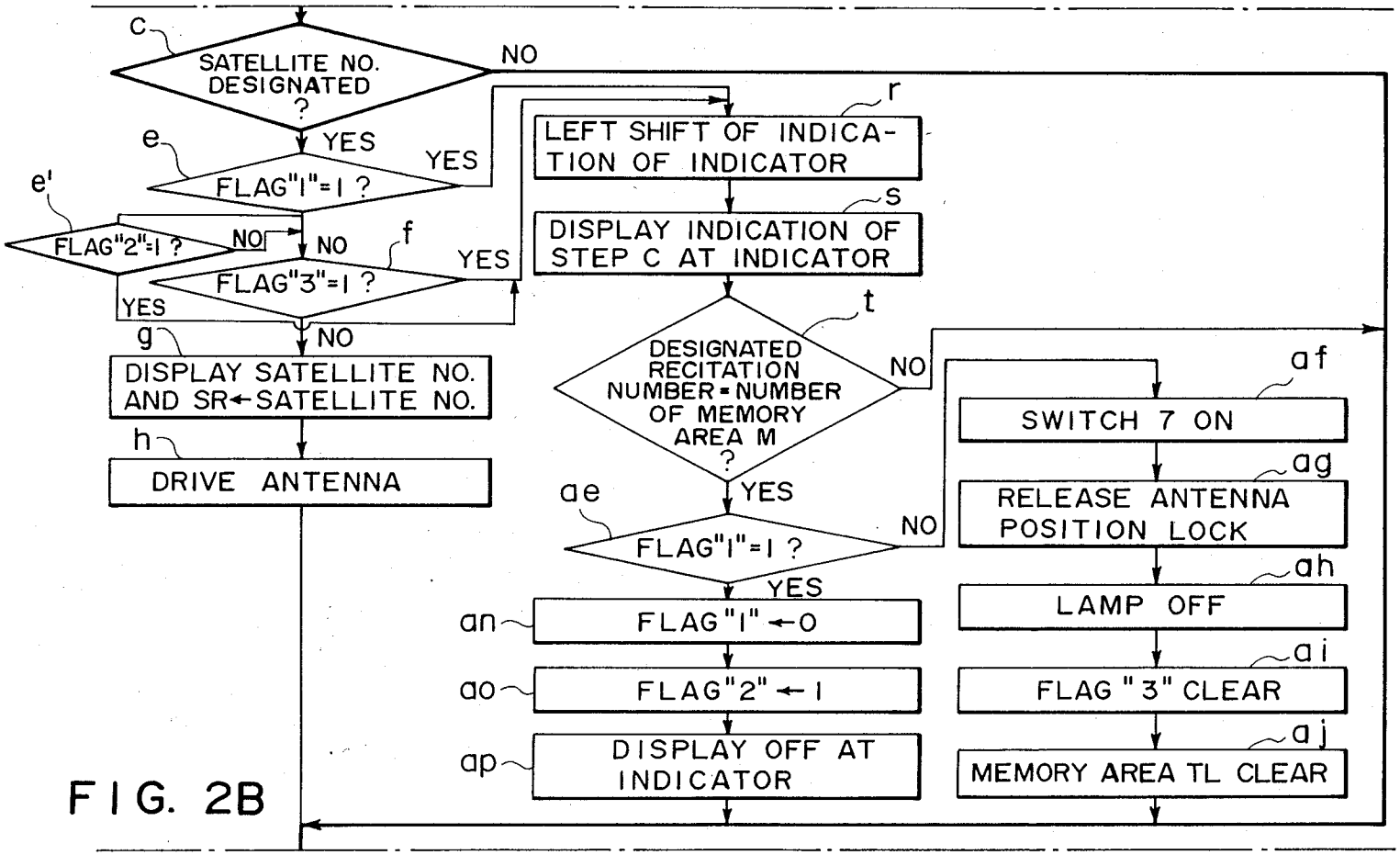
Figures 2, 2C:
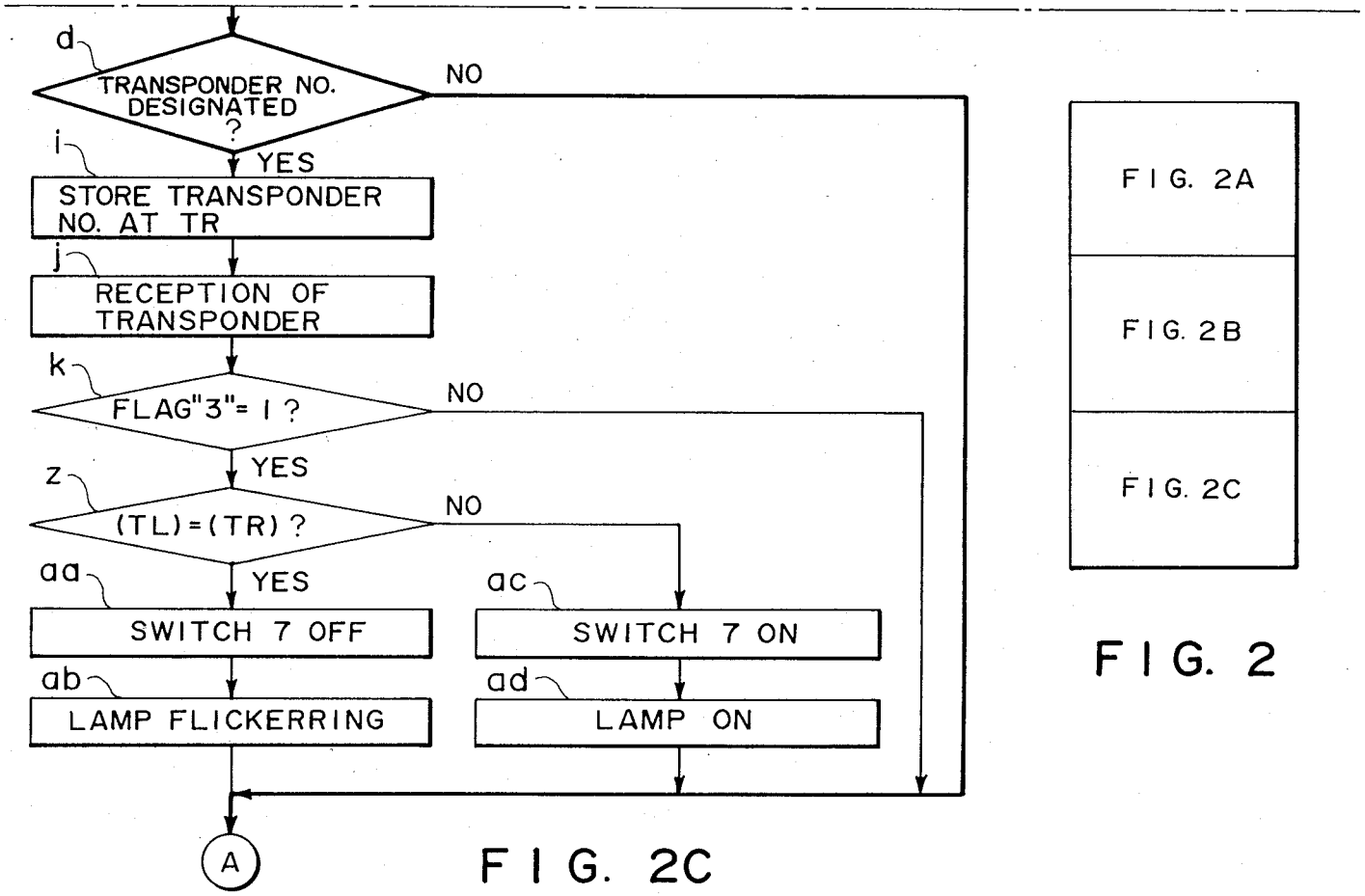

Referring to FIG. 1, a receiver 1 is provided with a control unit 5 consisting of a microcomputer. The control unit 5 essentially comprises a CPU 51, a ROM 52 in which programs are stored, a RAM 53 to store data, an input port 54, and an output port 55. The RAM 53 is provided with memory areas SR, TR, M, and TL, and a flag area F. The memory area SR stores the number corresponding to the satellite which is selected. The memory area TR stores the number corresponding to the transponder which is selected. The memory area M stores the recitation number to lock. The memory area TL stores the number corresponding to the transponder which is locked. The flag area F stores three first to third flags.

The receiver 1 is also provided with a satellite designation key 2, a transponder designation key 3, and a lock instruction key 4. The satellite designation key 2 consists of, e.g., a ten-key switch and serves to designate the number corresponding to the selected satellite. The transponder designation key 3 serves to designate the number corresponding to the selected transponder. The lock instruction key 4 serves to instruct the lock and change of the recitation number. The outputs of the keys 2 to 4 are supplied to the input port 54. These outputs are then supplied from the input port 54 to the CPU 51 and subjected to the processes for comparison and the like in accordance with the program stored in the ROM 52. The data processed by the CPU 51 is supplied through the output port 55 to a demodulator 6, a switch 7, a display 9, and an antenna controller 10 in accordance with the program stored in the ROM 52. The switch 7 is arranged between the demodulator 6 and a television (TV) receiver 8 and serves to selectively disconnect the video signal and the audio signal. The display 9 is composed of an indicator 91 to display the number corresponding to the satellite and the number corresponding to the transponder and a lamp 92 to indicate the state of the parental lock. The number corresponding to the satellite is referred to as the satellite number and the number corresponding to the transponder is referred to as the transponder number hereinafter.

As will be obvious from the description in conjunction with flowcharts, which will be explained later, the satellite designation switch 2 also serves as a switch to set the recitation number. When the lock instruction key 4 is pressed once, the parental lock is performed. When the key 4 is continuously pressed twice, the recitation number is changed. In addition, flag "1" is used to discriminate from the instruction of change of the recitation number to the end of this change. Flag "1" is set by continuously pressing the lock key 4 twice. Flag "2" is used to discriminate whether the recitation number has newly been set or not. Flag "3" is used to discriminate whether the parental lock has been made or not.

The outline will be described before the operation sequence of the embodiment is explained in detail.

To perform the parental lock, the satellite and transponder which are intended to be locked are selected and the lock instruction key 4 is pressed once. Thus, the lamp 92 flickers and the number of the selected transponder is stored into the memory area TL and the parental lock is executed.

When the transponder is selected in the parental locked state, a check is made to see if the selected transponder coincides with the parental locked transponder or not. If YES, the lamp 92 flickers and the video image cannot be seen and the audio sound cannot be heard as well. If they are not coincident, the lamp 92 is lit up and the video image and the like are returned to the normal states, so that the program can be seen and heard in an ordinary manner. In this case, the satellite cannot be selected nor changed.

The parental locked state is released by inputting the recitation number to cancel the lock. In the embodiment, the data which is inputted from the satellite designation key 2 in the parental locked state is handled as the recitation number. A check is then made to see if the input recitation number coincides with the memory content of the memory area M or not. If they are coincident, the lamp 92 is lit off and the memory content of the memory area TL, namely, the number of locked transponder is cleared. Thus, the parental lock is released. If they are not coincident, the parental lock is not released but it is necessary to again input the recitation number.

The lock instruction key 4 is continuously pressed twice to change the recitation number. Due to this, the indication of the indicator 91 is lit off and the lamp 92 flickers. Next, the recitation number is inputted. A check is made to see if the input recitation number coincides with the memory content of the memory area M or not. If they coincide, the recitation number indication of the indicator 91 is lit off. Subsequently, by inputting the new recitation number and pressing the lock instruction key 4 once, the new recitation number is stored into the memory area M. Thereafter, the lamp 92 is lit off and the indicator 91 displays the number of selected satellite and the number of selected transponder.

Operation Sequence

When the program starts, flags "1" to "3" are cleared and the recitation number is stored into the memory area M. After completion of the initialization, the receiver waits until the satellite designation key 2, transponder designation key 3, or lock instruction key 4 is pressed.

It is now assumed that none of the keys 2 to 4 is pressed. In the program sequence, a check is first made to see if the key 4 has been pressed once within a predetermined period of time or not (step a). If NO in step a, a check is then made to see if the lock instruction key 4 has continuously been pressed twice within a predetermined period of time or not (step b). If NO in step b, a check is made to see if the satellite designation key 2 has been pressed or not (step c). If NO in step c, a check is made to see if the transponder designation key 3 has been pressed or not (step d). If NO in step d, step a is executed. Namely, when none of the keys 2 to 4 is pressed, the steps a to d is repeated.

First, the operator ordinarily presses the satellite designation key 2 for reception. The depression of the key 2 is detected by the CPU 51 and a check is made to see if flag "1" has been set or not (step e) subsequent to step c. If NO in step e, namely, when the lock instruction key 4 is not continuously pressed twice and the change of the recitation number is not instructed, a check is then made to see if flag "3" has been set or not (step f) subsequent to step e. If flag "3" is not set in step f, namely, when the parental lock is not performed yet, the number of the satellite designated by the key 2 is displayed by the indicator 91 and also stored into the memory area SR (step g). Next, the code data corresponding to the number of the satellite designated by the key 2 is supplied to an antenna controller 10 (step h). In response to the code data, the antenna controller 10 drives a motor 11, thereby allowing an actuator to direct a parabola antenna 12 toward the satellite designated by the key 2.

When the operator subsequently presses the transponder designation key 3, this depression is detected by the CPU 51 and the number of the transponder designated by the transponder designation key 3 is displayed by the indicator 91 and also stored into the memory area TR (step i ) subsequent to step d. Next, the data corresponding to the designated transponder number is supplied to the demodulator 6. The demodulator 6 is tuned so as to receive the frequency signal of the designated transponder in accordance with the supplied data and the received signal is demodulated. An output of the demodulator 6 is supplied to the TV receiver 8 through the switch 7 and received (step j). After step j, a check is made to see if flag "3" has been set or not (step k). If NO in step k, namely, when the parental lock is not performed yet, step a is executed after step k.

As described above, the satellite and transponder are selected and a desired radio wave is received.

When the lock instruction key 4 is then once pressed, this depression is detected by the CPU 51 and a check is made to see if flag "2" to discriminate the new setting of the recitation number has been set or not (step l) after step a. If NO in step l, namely, when the parental lock is executed, lamp 92 flickers (step m) after step l. After step m, the memory content indicative of the selected transponder number in the memory area TR is transferred to the memory area TL and set to the transponder number which is locked (step n). Flag "3" representative of the lock state is set (step o). After step o, the code data to lock the selected position of the satellite is supplied to the antenna controller 10 (step p). The controller 10 mechanically fixes the rotational position of the parabola antenna 12 to the position responsive to the code data. Therefore, the parabola antenna is fixed toward the satellite selected immediately before locking. After step p, the switch 7 is turned off (step q). Thus, the parental lock is performed in step n and the video image cannot be seen and the audio sound cannot be heard. When the satellite is designated by the satellite designation key 2 in step c in the parental locked state, flag "3" has already been set to 1, so that none of steps g and h is executed. The antenna controller 10 doesn't drive the parabola antenna 12.

By pressing the satellite designation key 2 after the parental lock was performed, steps e and f are executed subsequent to step c. In this case, since the lock instruction key 4 is not continuously pressed twice, flag "1" is not set but in step o, flag "3" is set to 1. Therefore, it is determined that flag "3" has been set in step f. After step f, the indication of the indicator 91 is shifted to the left (step r). Then, the satellite number designated by the satellite designation key 2 is sequentially indicated in the least digit of the indicator 91 (step s). After step s, a check is made to see if the memory content of the memory area M coincides with the display content of the indicator 91 or not (step t). In this case, the number designated by depressing the satellite designation key 2 is taken as the recitation number designated. By repeating this operation, the recitation number is designated due to the depression of the satellite designation key 2.

Next, even if the key 2 is newly pressed in the parental locked state as well, flag "3" is set in this state, so that step r is executed but steps g and h are not executed. Consequently, the parabola antenna 12 is not driven and the satellite is not selected and the number designated by pressing the satellite designation key 2 is processed as the recitation number designated. Therefore, step t is executed after steps f, r, and s and a check is made to see if the memory content of the memory area M coincides with the recitation number designated by the key 2 or not. If they don't coincide in step t, step d is executed after step t. The selection of new satellite is inhibited as mentioned above, but the transponder can be selected. When the transponder is designated by the transponder designation key 3, steps i, j, and k are executed after step d. In this case, it is determined in step k that flag "3" has been set, so that the memory content of the memory area TR and the memory content of the memory area TL are compared (step z) after step k. If they coincide in step z, the switch 7 is turned off (step aa). Then, the lamp 92 flickers (step ab) and the receiver waits until step a and subsequent steps are executed. Therefore, when steps aa and ab were executed, the video image is not displayed by the receiver and the audio sound is not generated therefrom. Thus, the parental locked broadcast cannot be seen nor heard unless the parental lock is released.

On the contrary, if they don't coincide in step z, the switch 7 is turned on (step ac) and the lamp 92 is lit up (step ad). The receiver then waits until the step a and subsequent steps are executed. Consequently, when steps ac and ad were executed, the video image and audio sound of the radio wave from the selected transponder can be displayed and generated by the receiver 1. In this case, the satellite cannot be selected but it is possible to display and hear only the radio wave from the parental unlocked transponder in the satellite to which the parabola antenna faces at present.

On the other hand, in the parental locked state, when the satellite designation key 2 is pressed and steps e, f, r, s, and t are executed and the memory content of the memory area M coincides with the recitation number designated by the satellite designation key 2 in step t, a check is made to see if flag "1" has been set or not (step ae) after step t. If NO in step ae, namely, when the lock instruction key 4 is not continuously pressed twice and the recitation number is not changed, the switch 7 is turned on (step af) after step ae. Then, the code data to unlock the selection of the satellite is supplied to the antenna controller 10 (step ag). The controller 10 again drives the antenna in accordance with the code data. After step ag, the lamp 92 is lit off (step ah) and flag "3" is reset (step ai). After step ai, the memory content of the memory area TL is cleared (step aj). Thus, the parental locked transponder doesn't exist any more and the parabola antenna is driven by the antenna controller 10 in correspondence to the designated satellite in step c. Further, the designated transponder is designated in correspondence to the transponder in step d. In this case, step a and subsequent steps are executed after step k and steps z and aa to ad are skipped.

As described above, the parental lock is released by inputting the recitation number which coincides with the recitation number stored previously, so that the satellite can be designated by the satellite designation key 2. In addition, the radio wave from the transponder designated by the transponder designation switch 3 can be displayed and heard.

When it is determined in step b that the lock instruction key 4 has continuously been pressed twice, flag "1" is set (step ak) after step b. Next, the indication of the indicator 91 is lit off (step al). After step al, the lamp 92 flickers (step am) and steps c and e are executed. Since it is decided that flag "1" has been set in step e (this corresponds to the case where the lock instruction key 4 is continuously pressed twice within a predetermined period of time to change the recitation number and thus flag "1" has been set in step ak), steps r, s, and t are executed after step e. Therefore, the recitation number is designated due to the depression of the key 2 in step c. When the newly designated recitation number coincides with the memory content of the memory area M in step t, a check is then made to see if flag "1" has been set or not (step ae). In this case, it is determined that flag "1" has been set in step ae similarly to the case in step e. After step ae, flag "1" is reset (step an) and flag "2" is then set (step ao) and the indication of the indicator 91 is lit off (step ap). Subsequent to steps a and b, the updated recitation number is set by pressing the satellite designation key 2. Since flap "1"=Ø and flap "2"=2 because steps an and ao have been taken. Accordingly, the sequence flows to steps r, s, and t. At step t, since the updated recitation number may be difference from that stores in memory area M, the sequence flows to step a. This depression is detected in step a, so that step l is executed after step a..Since flag "2" has been set in step ao, the display content of the indicator 91 (in this case, the recitation number is displayed on the indicator 91) is stored into the memory area M (step v) after step l. Thus, the recitation number is stored into the memory area M. After step v, flag "2" is reset (step w) and the lamp 92 is lit off (step x). After step x, the memory contents stored in the memory areas SR and TR are displayed on the indicator 91 (step y). Therefore, the indication on the indicator 91 is returned to the indication before the recitation number is set. The updated recitation number is newly stored into the memory area in place of the previous recitation number and the recitation number is updated in this manner.

What is claimed is:

1. A satellite receiver for receiving and reproducing a signal from a transponder of a satellite, comprising:

a receiver unit means;

said receiver unit means having an output means for supplying a demodulated signal from designated satellite and transponder;

a reproduction unit means for exhibiting a reproduction of the demodulated signal from the output means of said receiver unit means;

a control unit means including (a) a first memory means for storing designated satellite and transponder numbers, and (b) a second memory means for storing satellite and transponder numbers to be locked by a parental lock signal, (c) a coincidence determining means for comparing the memory contents of said first memory means with said second memory means to determine whether said designated satellite and transponder numbers corresponds with said satellite and transponder numbers to be locked, and (d) a means for generating a parental lock signal when said coincidence determining means determines that the memory contents of said first and second memory means coincide;

a means for disabling the reproduction at said reproduction unit means for the demodulated signal which has been received from said designated satellite and transponder in response to said parental lock signal;

a third memory means for storing a recitation number and means for inputting a recitation number, wherein the inhibition of reproduction by said means for disabling is released in response to the occurrence of a coincidence between the stored recitation number and the input recitation number; and a flag means responsive to a recitation number update instruction for raising a flag, wherein said control unit responsive to the coincidence of the input recitation number with the recitation number stored in said third memory means releases the receiver from the parental lock when said flag means does not raise the flag and rewrites said third memory with the input updated recitation number when said flag means raises the flag.

2. A satellite receiver according to claim 1, wherein said control unit means transfers the memory content of said first memory means into said second memory means in response to said parental lock instruction.

3. A satellite receiver for receiving and reproducing a signal from a designated satellite, comprising:

a receiver unit means;

a control unit means responsive to a parental lock instruction for entering into a parental lock mode;

a recitation memory storage means for storing a recitation code which is used for release of the parental lock mode; and a means for entering a reference code and an update recitation code to said control unit means;

said control unit means also being responsive to the coincidence of (a) the entered reference code with (b) the recitation code which is stored in said recitation memory storage means for rewriting said recitation memory storage means with the entered update recitation code.

4. A satellite receiver according to claim 3, wherein the reproduction of the signal from the designated satellite is inhibited in the parental lock mode.

5. A satellite receiver according to claim 3, wherein an antenna is mechanically locked in the parental lock mode.

6. A satellite receiver for receiving and reproducing a signal from a designated satellite, comprising:

a receiver unit means;

a control unit means responsive to a parental lock instruction for entering a parental lock mode;

a recitation memory storage means for storing a recitation code;

a flag means responsive to a recitation code update instruction for raising a flag; and a means for entering a reference code and an update recitation code to said control unit means;

said control unit means also being responsive to the coincidence of the entered reference code with the recitation code which is stored in said recitation memory storage means for releasing the parental lock mode when said flag means does not raise the flag and for rewriting said recitation memory storage means with the entered update recitation code when said flag means raises the flag.

* * * * *